US005455099A

United States Patent [19]

Banner

[11] Patent Number: 5,455,099

[45] Date of Patent: Oct. 3, 1995

[54] VINYL SHAKE

[76] Inventor: Norman Banner, 2981 Malcolm Ct., Oceanside, N.Y. 11572

[21] Appl. No.: 301,538

[22] Filed: Sep. 6, 1994

[51] Int. Cl.[6] ..... B32B 3/04

[52] U.S. Cl. ..... 428/122; 428/126; 428/130; 428/131; 52/313; 52/530; 52/531; 52/555; 52/545

[58] Field of Search ..... 428/99, 60, 122, 428/126, 128, 129, 130, 131; 52/313, 555, 545, 558, 521, 522, 530, 531

[56] References Cited

U.S. PATENT DOCUMENTS 3,363,380 1/1968 Merrill ..... 52/530
3,593,479 7/1971 Hinds et al. ..... 52/313

*Primary Examiner*—Alexander S. Thomas

*Attorney, Agent, or Firm*—Philip Sands

[57] ABSTRACT

A vinyl shake for being affixed to an exterior wall of a building is disclosed. The shake comprises a textured sheet having an upper flanged portion and a lower flanged portion, the upper flanged portion being bent downwardly on one side of the textured sheet, the lower flanged portion being bent upwardly on the reverse side of the textured sheet, the upper flanged portion including at least one opening formed therein, the textured sheet including at least one opening formed therein and aligned coaxially with the opening formed in the upper flanged portion, the upper flanged portion including a lip laterally coextensive therewith and extending downwardly below and beyond the coaxially aligned openings formed in the upper flanged portion and textured sheet.

The forgoing abstract is neither intended to define the invention disclosed, nor is it intended to be limited as to the scope in any way.

6 Claims, 4 Drawing Sheets

VINYL SHAKE

BACKGROUND OF THE INVENTION

The present invention relates generally to plastic shake used for siding an exterior wall of a building. More particularly, the present invention relates to vinyl shake having a textured appearance for imparting to the exterior walls of a building a rustic or wood-like appearance typically conveyed by wood shake panels and the like.

The vinyl material of the shake of the present invention is noteworthy in that it is more highly weather-resistant than is aluminum or wood otherwise conventionally used for siding a building. However, because of the vinyl composition of the shake, and the properties of vinyl, the vinyl shake is more apt to expand and contract to an extent that is much greater than is typically associated with aluminum and/or wood shake.

As a consequence, when a vinyl shake is exposed to extreme temperature of the summer heat and winter cold, the various interconnecting elements between each vinyl shake of the conventional variety may loosen and result in a dislodgment eventually of the adjoining shake members.

Another difficulty typically associated with conventional means for securing vinyl shake siding to a building is the fact that often the nailing is exposed at least partially to the weather elements and is subject to deterioration.

An object of the present invention, hence, is to separate the manner by which the neighboring or adjoining shake members are joined or interlocked with one another, on the one hand, and the manner by which each of the shake members is affixed to the exterior wall of a building by nailing, which nailing is concealed from exposure to the weather conditions, and is thereby protected.

It is another object of the present invention to insure that as each vinyl shake member undergoes severe expansion and contraction, as a consequence of the extreme weather conditions to which the shake are exposed at different times of the year, that the expansion and contraction do not affect the manner and integrity by which the shake members, on the one hand, are secured to the exterior wall of a building and, on the other hand, remain interlocked with one another.

It is a further object of the present invention to provide shake members of vinyl material that are durable, reliable, and that are aesthetically pleasing in the form typically conveyed by wood shake.

Further objects and advantages of this present invention will become apparent hereinafter as the description of the invention proceeds.

SUMMARY OF THE INVENTION

Briefly stated, and in accordance with the present invention, there is provided a plastic shake, preferably vinyl, to be affixed to an exterior wall of a building, the shake comprising a textured sheet having an upper flanged portion and a lower flanged portion. The upper flanged portion is bent downwardly on one side of the textured sheet, whereas the lower flanged portion is bent upwardly on the reverse side of the textured sheet. The upper flanged portion includes at least one opening formed therein, whereas the textured sheet includes at least one opening formed therein and aligned coaxially with the opening formed in the upper flanged portion. The upper flanged portion further includes a lip that is laterally coextensive therewith and extends downwardly below and beyond the coaxially aligned openings formed in the upper flanged portion in the textured sheet.

It is anticipated that each shake member described above will cooperate with a similar such structured shake member, one above and another below, by being interlocked to one another separately and independently of the manner by which each shake member is otherwise affixed to the exterior wall of a building.

In this regard, the upper flanged portion of a given shake member is adapted to seat within a laterally or horizontally extending channel formed by the lower flanged portion of an upperwardly situated shake member upon the exterior wall of a building. The successively interfitting upper flanged portion of one shake member with a lower flanged portion of an upper situated shake member provides, on the one hand, for the interlocking relationship of each of the shake members with vertically adjoining shake members, and on the other hand, protective concealment of the nails used to secure or fasten each shake member to the exterior wall of a building.

The foregoing relationship of each of the shake members with one another and with the manner by which each is affixed to the exterior wall of a building will be better understood from the description of the invention as hereinafter follows.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
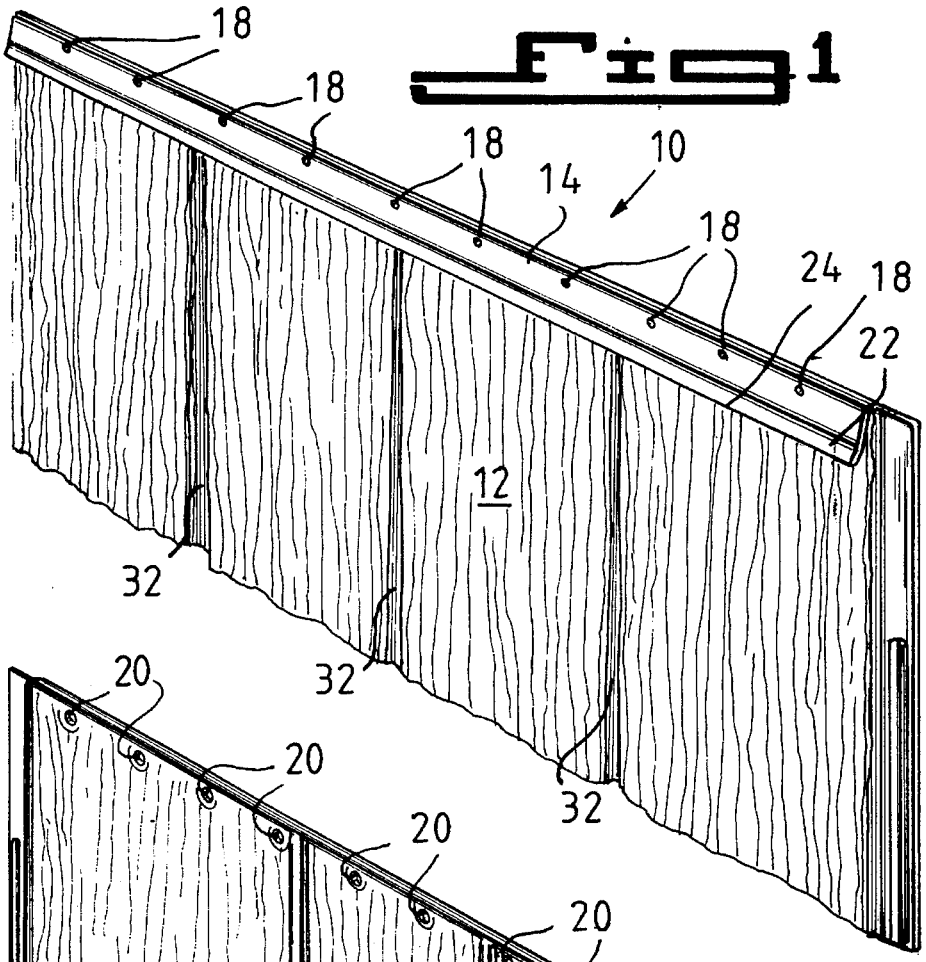
FIG. 1 is a perspective view of the front side of the vinyl shake of the present invention.

With continued reference to the drawings, wherein like reference numerals have been used throughout to designate like elements, the present invention is designated generally by the reference character 10.

The vinyl shake member 10 of the present invention, as illustrated in FIG. 1, comprises a textured vinyl sheet 12 having an upper flanged portion 14 and a lower flanged portion 16.

The upper flanged portion 14 is bent downwardly on one side of the textured sheet 12, whereas the lower flanged portion 16 is bent upwardly on the reverse side of the textured sheet 12.

The upper flanged portion 14 is formed with a plurality of openings 18 which are spaced from one another laterally or horizontally along the upper flanged portion 14.

Figure 2:
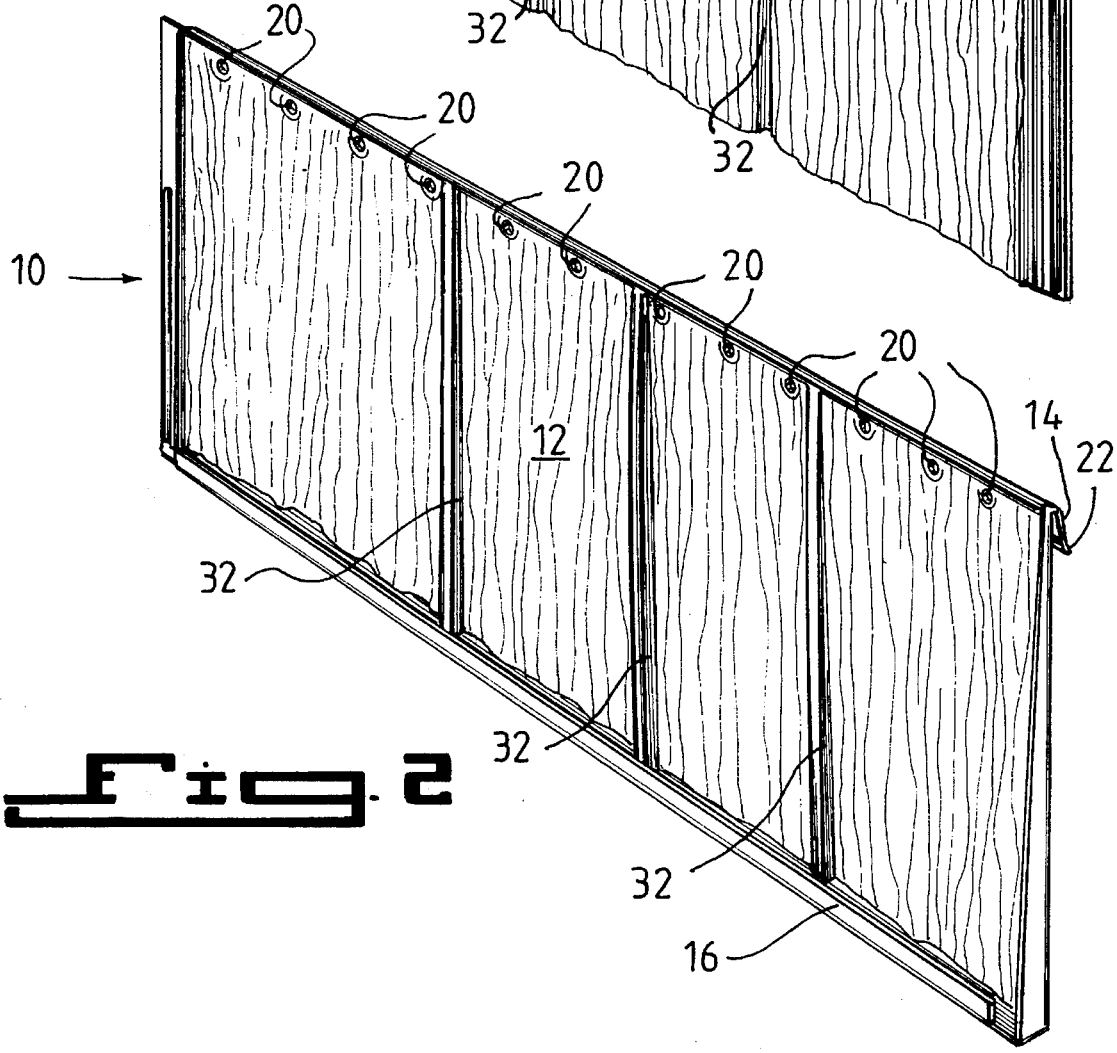
FIG. 2 is a perspective view of the opposite or reverse side of the vinyl shake of the present invention.

On the other hand, the textured sheet 12, as best illustrated in FIG. 2, is formed with a plurality of openings 20 therein, each of the openings 20 being coaxially aligned with a respective one of the openings 18 formed in the upper flanged portion 14.

As best illustrated in FIG. 1, the upper flanged portion 14 further includes a lip 22 that is laterally coextensive therewith and extends downwardly below and beyond the coaxially aligned openings 18 and 20 formed respectively in the upper flanged portion 14 and textured sheet 12. The lip 22 is preferably outwardly inclined, or bent at an angle, relative to the balance of the upper flanged portion 14 integral therewith from above.

For purposes that will be explained hereinafter below, the lip 22 of the upper flanged portion 14 has a free edge 24 that is spaced downwardly over a distance from each of the openings 18 that exceeds the upward extent of the lower flanged portion 16 from the very bottom of the textured sheet 12 to the upper free edge 26 of the lower flanged portion 16.

Figures 3, 4:
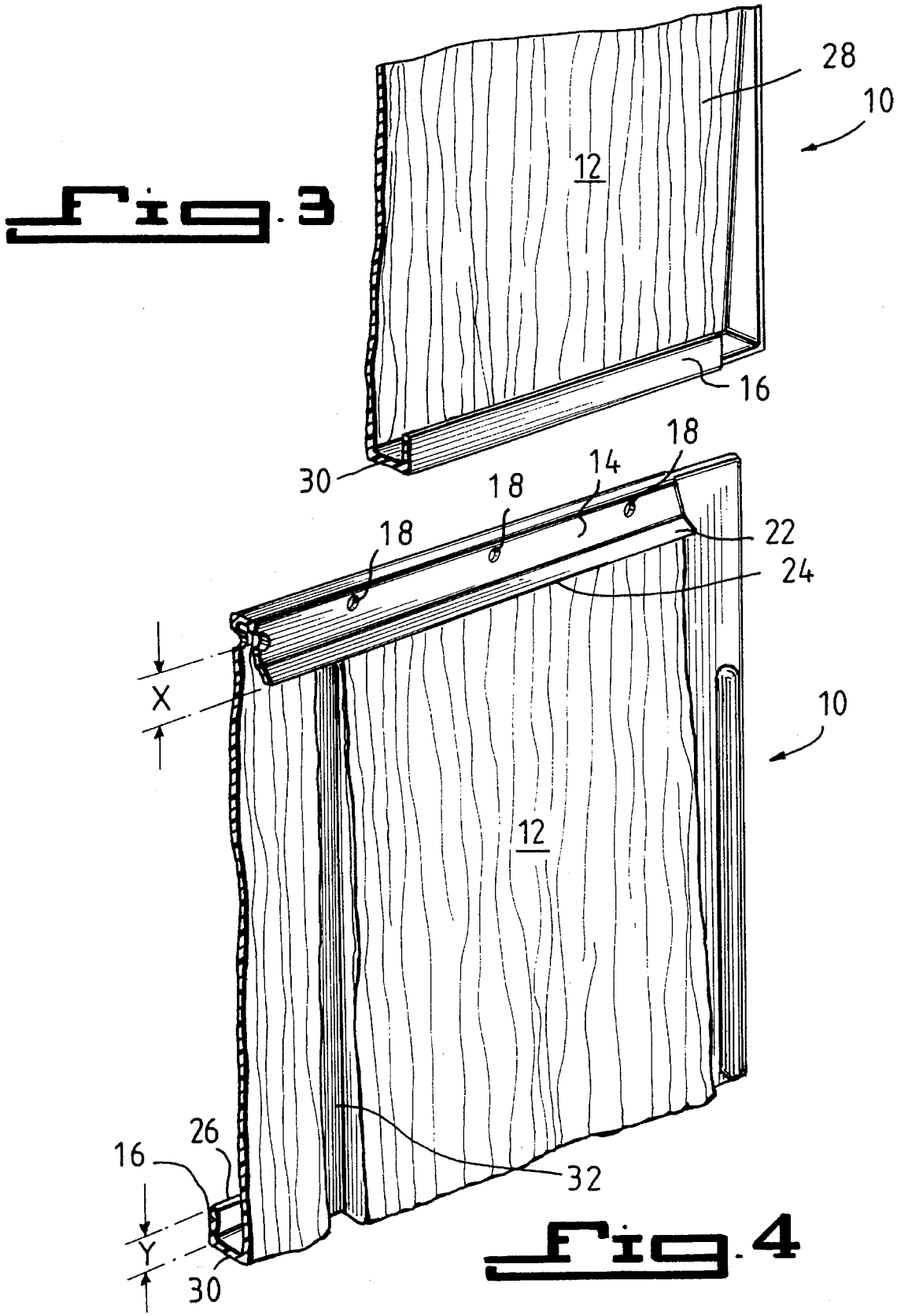
FIG. 3 is an enlarged, fragmentary view of the reverse side of the vinyl shake illustrating the bottom ledge thereof.
FIG. 4 is an enlarged, fragmentary view of the front side of the vinyl shake illustrating a reinforcing rib thereof.

In particular, as best illustrated in FIG. 4, the distance X between the free edge 24 of the upper flanged portion 14 and the openings 18 formed in the upper flanged portion 14 is greater than the distance Y between the very bottom of the textured sheet 12 and the upper free edge 26 of the lower flanged portion 16.

As best illustrated in FIG. 3, the reverse or rear side 28 of the shake member 10 is formed with a bottom ledge 30 that extends perpendicular thereto and is integral therewith, the lower flanged portion 16 integrally extending from the ledge 30 and being laterally coextensive therewith.

As best illustrated in FIG. 4, the textured sheet 12 is formed with at least one rib 32 that extends from the upper flanged portion 14 downwardly to the ledge 30 of the lower flanged portion 16, the rib 32 being in the form of a channel having a minimum depth at the upper flanged portion 14, and gradually deepening to a maximum depth at the ledge 30 of the lower flanged portion 16.

Figure 5:
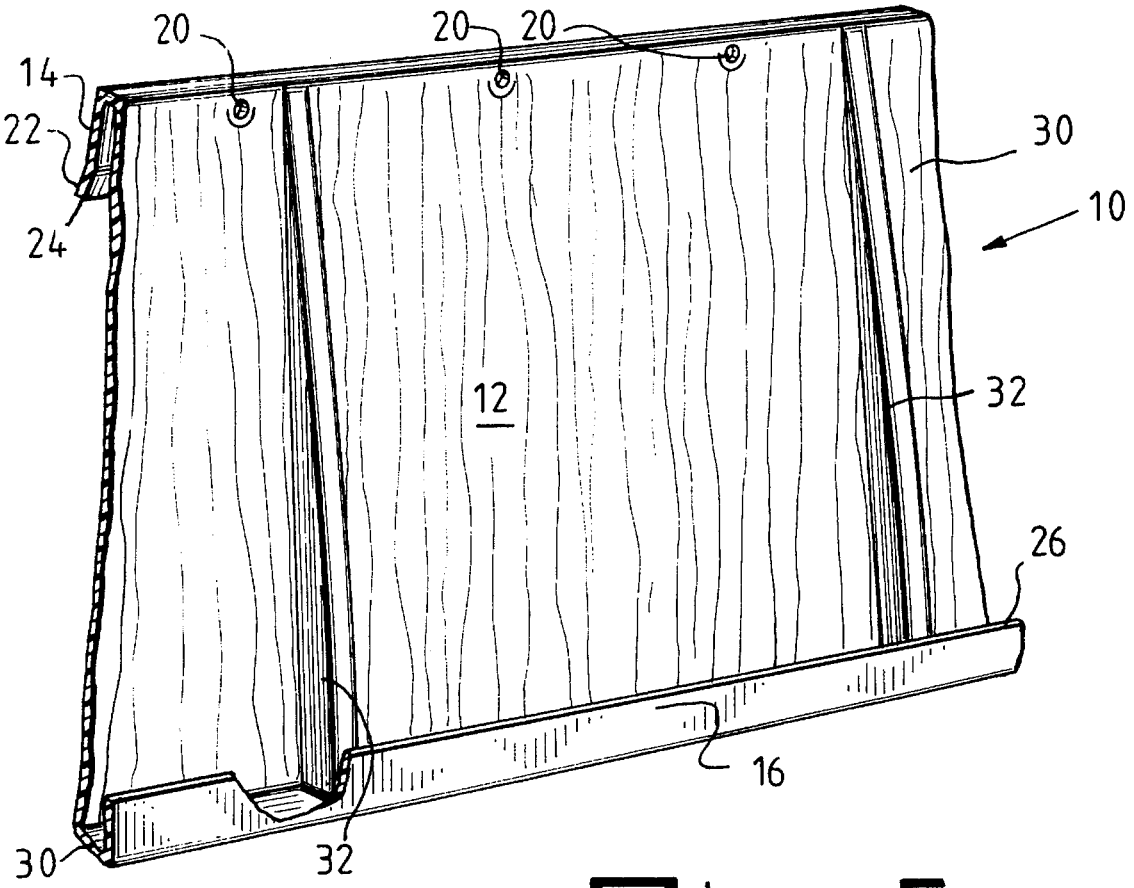
FIG. 5 is an enlarged, fragmentary view of the reverse side of the vinyl shake illustrating the triangular, deepening contour of a reinforcing rib of the present invention.

The gradually deepening channeled rib 32 is best illustrated in FIG. 5 along the opposite or reverse side of the textured sheet 12, the rib 32 having a generally triangular appearance as it deepens in depth from the upper flanged portion 14 downwardly to the lower flanged portion 16.

Referring once again to FIGS. 1 and 2, it will be seen that the diameter or size of the openings 20 formed in the opposite or reverse side of the textured sheet 12 is greater than the openings formed in the upper flanged portion 14. The reason for providing for the larger sized openings 20 formed in the textured sheet 12 is to compensate for the anticipated irregularity that comes along with fastening of the shake member 10 to a wall of a building, the irregularity as associated with a bending of the shake member 10 to conform to the irregular so-called flat surface of the building.

As a consequence of the irregularity, the smaller openings 18 originally coaxially formed in alignment with respective ones of the larger openings 20 are forced out of precise alignment during the fastening process, and the larger size openings 20 thereby permit insertion of respective fastening nails through the then partially mal-aligned openings 18 and 20 still perpendicularly to the building wall.

Figure 6:
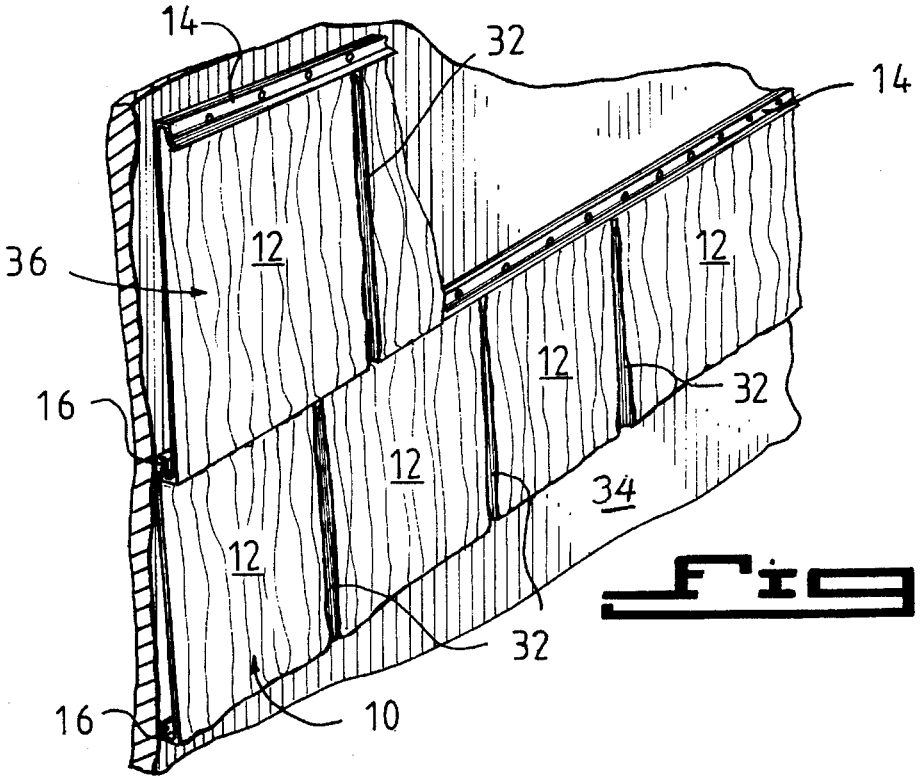
FIG. 6 is a perspective view, partly in phantom, illustrating the manner by which the vinyl shake members of the present invention interconnect to one another and to an exterior wall of a building.
Figure 7:
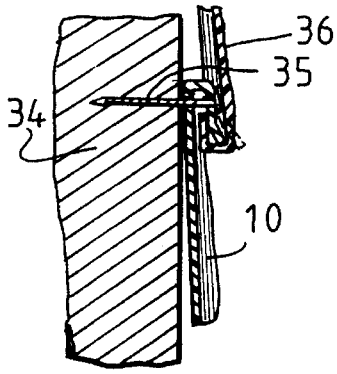
FIG. 7 is an enlarged, cross-sectional view illustrating the concealment of the nailing elements.

Referring now to FIGS. 6 and 7, in use, the shake member 10 of the present invention may be nailed to the bottom of an exterior wall 34 of a building. Individual nails 35 can be hammered through the coaxially or near-coaxially aligned openings 18 and 20 formed in the upper flanged portion 14 and the textured sheet 12.

With the shake member 10 installed at the bottom of a building wall 34 as shown in FIG. 6, a second such shake member 10 can be installed above the bottom one. The upper shake member 10 to be installed is designated by reference character 36.

To install the upper shake member 36 upon the building wall 34 just above the lower shake member 10, the lower flanged portion 16 of the upper shake member 36 must be slid between the upper flanged portion 14 and the front side of the textured sheet 12 and held in that position while nails are hammered through the openings 18 and 20 formed in the upper flanged portion 14 and the textured sheet 12.

The upper shake 36 is thereby constrained at its upper most portion by nailing, and at its lower most portion, at the lower flanged portion 16 thereof, by being interfitted between the upper flanged portion 14 and the front surface of the textured sheet 12 presented by the lower shake member 10.

Because of the greater vertical extent "X" of the upper flanged portion 14 from the openings 18 formed therein to the lower free edge 24 thereof, as compared to the distance "Y" between the upper free edge 26 of the lower flanged portion 16 to the very bottom of the shake 10, the lower flanged portion 16 remains out of contact with, and isolated from, the nails hammered through the coaxially aligned openings 18 and 20 in the upper flanged portion 14 and the textured sheet 12.

Because of the larger size of the openings 20 formed in the textured sheet 12 as compared to those openings 18 formed in the smoother upper flanged portion 14, when the textured sheet 12 is irregularly bent to conform to the so-called flat surface of the building wall, the openings 18 and 20 remain at least partially aligned for insertion of the fastening nails perpendicularly to the building wall for proper nailing thereto.

Figure 8:
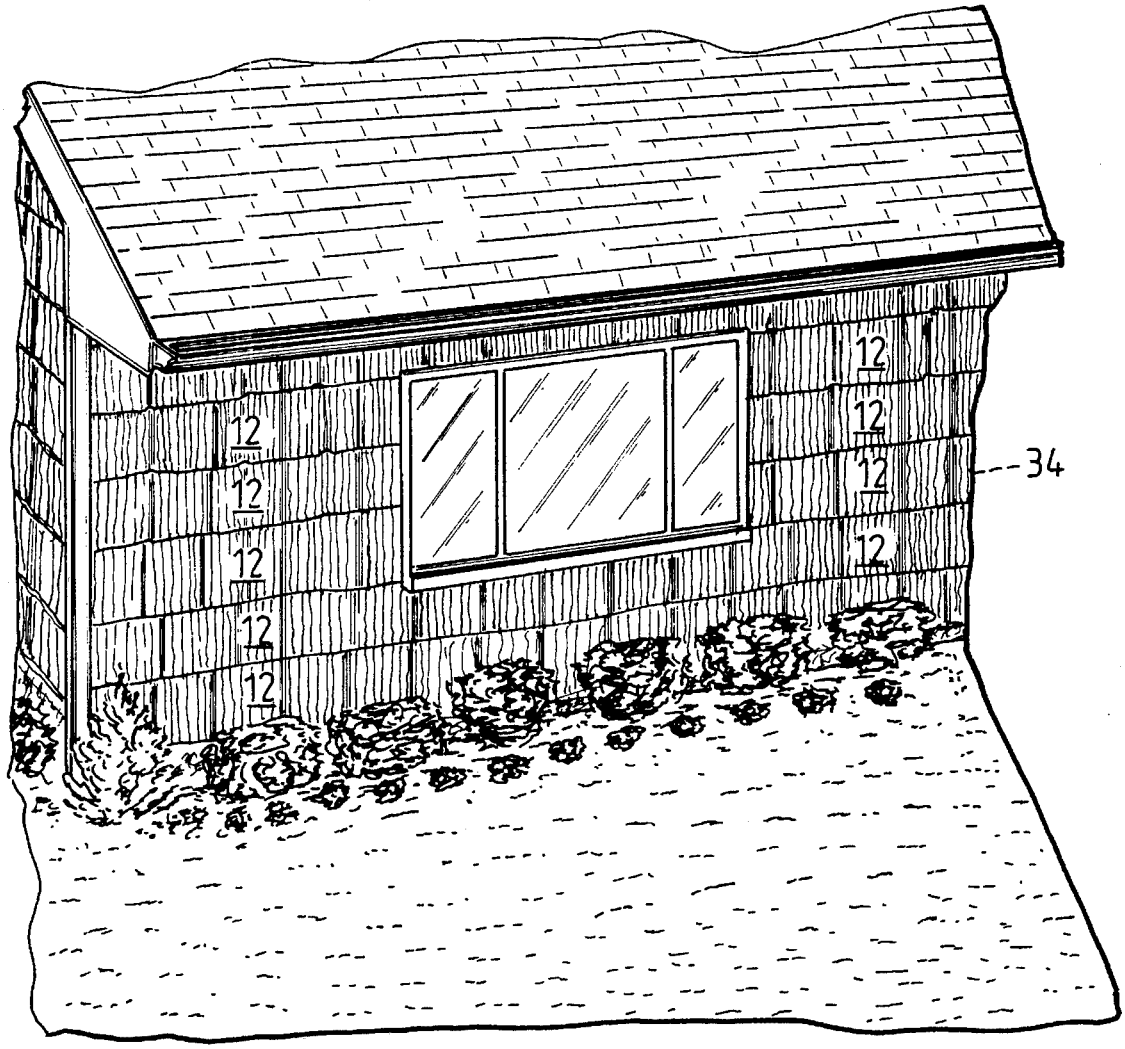
FIG. 8 is a perspective view of a building upon which are installed the shake members of the present invention.

The foregoing description of the manner by which the upper shake member 36 is secured both to the lower shake member 10 and to the building wall 34 should be considered repetitive with respect to each and every additional shake member to otherwise be secured to the building wall 34 and to a respective lower shake member 10 pursuant to the present invention, for a result illustrated in FIG. 8.

It will be also understood that as each lower flanged portion 16 interfits over and upon an upper flanged portion 14, the nails which project through the coaxially aligned openings 18 and 20 are thereby insulated from any exposure to the weather elements, and are thereby less likely to rust and deteriorate.

It will be understood moreover that the shake of the present invention very simply, and with a minimum of additional fastening elements, such as nails or the like, may be secured one upon the other and upon the building wall 34 rapidly just by interfitting a lower flanged portion 16 onto an upper flanged portion 14 of a lower shake 10 and nailing the upper portion of the shake member 10 through the coaxially aligned openings 18 and 20.

Having thus set forth the nature of the present invention, it will be understood that the foregoing is not to be restrictive in any manner, but rather to be defined within the scope of the appended claims.

What is claimed is:

1. A plastic shake for being affixed to an exterior wall of a building, the shake comprising a textured sheet having an upper flanged portion and a lower flanged portion, the upper flanged portion being bent downwardly on one side of the textured sheet, the lower flanged portion being bent upwardly on the reverse side of the textured sheet, the upper flanged portion including at least one opening formed therein, the textured sheet including at least one opening formed therein and aligned coaxially with the opening formed in the upper flanged portion, the upper flanged portion including a lip laterally coextensive therewith and extending downwardly below and beyond the coaxially aligned openings formed in the upper flanged portion and textured sheet, the opening formed in the upper flanged portion being of a lesser diameter than the opening coaxially aligned therewith and formed in the textured sheet.

2. A plastic shake as claimed in claim 1, wherein said lip is outwardly inclined relative to the balance of the upper flanged portion.

3. A plastic shake as claimed in claim 1, wherein said upper flanged portion, from the opening formed therein, extends downwardly over a distance that exceeds the upward extent of the lower flanged portion.

4. A plastic shake as claimed in claim 1, wherein the lower flanged portion includes a ledge extending perpendicular to, and formed integral with, the textured sheet.

5. A plastic shake as claimed in claim 4, wherein said textured sheet is formed with at least one rib extending from the upper flanged portion downwardly to the ledge of the lower flanged portion, the rib being in the form of a channel having a minimum depth at the upper flanged portion and a maximum depth at the ledge of the lower flanged portion.

6. A plastic shake as claimed in claim 1, wherein the plastic is vinyl.

* * * * *